US006131914A

United States Patent [19]

Proveaux

[11] Patent Number: 6,131,914

[45] Date of Patent: Oct. 17, 2000

[54] GAS TURBINE ENGINE BEARING COMPARTMENT SEAL

[75] Inventor: Sanford B. Proveaux, Lantana, Fla.

[73] Assignee: United Technologies Corporation, Hartford, Conn.

[21] Appl. No.: 08/705,388

[22] Filed: Aug. 30, 1996

[51] Int. Cl.[7] ..... F16J 15/447

[52] U.S. Cl. ..... 277/412; 277/418

[58] Field of Search ..... 277/53, 13, 14 R, 277/411, 412, 414, 418, 419, 423, 429, 409; 415/110, 111, 171.1, 173.5, 174.5

[56] References Cited

U.S. PATENT DOCUMENTS

| | | | |
|---|---|---|---|
| 2,020,002 | 11/1935 | Schweich | 277/423 |
| 4,453,784 | 6/1984 | Kildea et al. | 308/187 |
| 4,468,066 | 8/1984 | Alcorta et al. | 308/187 |
| 4,754,984 | 7/1988 | Keba | 277/53 |
| 5,088,889 | 2/1992 | Wolff | 277/423 |
| 5,211,535 | 5/1993 | Martin et al. | 415/170.1 |
| 5,239,750 | 8/1993 | Wright | 29/888.3 |

*Primary Examiner*—Daniel G. DePumpo
*Attorney, Agent, or Firm*—Richard D. Getz

[57] ABSTRACT

A seal for coaxial inner and outer spools rotatable about an axis is provided which includes a flange having a catch surface. The flange is attached to the outer spool, and is disposed between the inner and outer spools such that the catch surface is in close proximity to the inner spool. The catch surface, which includes a seal end and a discharge end, is canted from the axis between the seal end and the discharge end. Liquid disposed between the inner spool and the catch surface is forced against the catch surface by centrifugal force when the spools rotate at a sufficient speed. The liquid is subsequently driven axially along the canted catch surface in the from the seal end to the discharge end, toward the bearing compartment.

2 Claims, 2 Drawing Sheets

GAS TURBINE ENGINE BEARING COMPARTMENT SEAL

The invention was made under a U.S. Government contract and the Government has rights herein.

BACKGROUND OF THE INVENTION

1. Technical Field

This invention relates to bearing compartments within gas turbine engines in general, and to bearing compartment lubricant seals, in particular.

2. Background Information

Modern gas turbine engines often include multiple coaxial spools connecting turbine stages to compressor and fan stages. Depending upon the application, the coaxial spools may co-rotate or counter-rotate, and may differ in rotational velocity. The difference in relative rotational velocity between co-rotating coaxial spools, for example, is almost always less than that of counter-rotating spools because the latter spools are rotating in opposite directions. Co-rotating and counter-rotating applications, consequently, are generally considered to be low rotational velocity and high rotational velocity applications, respectively. Bearings disposed between the two spools maintain concentricity between the spools and facilitate relative motion. Oil, or synthetic lubricant, is fed into the bearing compartments to lubricate and cool the bearings.

Under present design practice, oil is maintained within the bearing compartment by a combination of seals and high pressure air bled off an upper stage compressor stage, sometimes referred to as "buffer air". Compartments adjacent the bearing compartment are maintained at a higher pressure than the bearing compartment (i.e., positively pressurized) and the buffer air is allowed to leak into the bearing compartment. The inflow of buffer air prevents outflow of oil. The buffer air and any oil that maybe entrained within the air is subsequently scavenged off, passed through a oil/air separator, and cycled back into the bearing compartment.

Contact seals and labyrinth seals are commonly used to seal spool bearing compartments. Contact seals, generally used when relative spool surface velocities are low (less than 425 feet per second), possess favorable sealing characteristics, but have contact velocity limitations. Labyrinth seals, on the other hand, are generally used when relative spool surface velocities are high (greater than 425 f.p.s.). A disadvantage of labyrinth seals is that they do not seal as well as contact seals. In fact, the amount of buffer air that must be bled into the bearing compartment when labyrinth seals are used (versus contact seals) is appreciable.

Several disadvantages emanate from using buffer air as a sealing means. One disadvantage is that air bled off for sealing purposes is initially at a high pressure and temperature. Before the air can be used as buffer air, it must be cooled through a heat exchanger. A significant drop in pressure occurs when the buffer air passes through the heat exchanger, leaving a minimal difference in pressure across the bearing compartment air seals. If the pressure within the adjacent compartments drops below that in the bearing compartment, undesirable hot air can be drawn in from nearby compartments, or oil can be drawn out of the bearing compartment, or both.

Another disadvantage of using buffer air for sealing purposes is that air bled off of the compressor for sealing purposes cannot be used as efficiently as it might have been elsewhere in the engine. Work imparted to air by the compressor directly increases the work produced in the downstream turbine, and therefore the efficiency of the engine. Work imparted to air bled off for sealing purposes, in contrast, is substantially expended during the sealing process and therefore does not directly increase the work done within the turbine.

Another disadvantage of using buffer air for sealing purposes is that heat exchangers, oil/air separators, and their associated hardware add complexity, weight, and cost to the engine.

What is needed is an apparatus for sealing liquids between spools of a gas turbine engine that at does not use buffer air and one that does not require heat exchangers, oil/air separators, and hardware associated therewith.

DISCLOSURE OF THE INVENTION

It is, therefore, an object of the present invention to provide an apparatus for sealing between spools that does not use buffer air.

An additional object of the present invention is to provide an apparatus for sealing between spools that does not require heat exchangers and/or oil/air separators.

An additional object of the present invention is to provide an apparatus for sealing between spools that does not negatively affect the efficiency of the engine.

An additional object of the present invention is to provide an apparatus for sealing between spools that does not negatively affect the reliability of the engine.

An additional object of the present invention is to provide an apparatus for sealing between spools that can be used in applications having high relative rotational velocities.

According to the present invention, a seal for coaxial inner and outer spools rotatable about an axis is provided which includes a flange having a catch surface. The flange is attached to the outer spool, and is disposed between the inner and outer spools such that the catch surface is in close proximity to the inner spool. The catch surface, which includes a seal end and a discharge end, is canted from the axis between the seal end and the discharge end. Liquid disposed between the inner spool and the catch surface is forced against the catch surface by centrifugal force when the spools rotate at a sufficient speed. The liquid is subsequently driven axially along the canted catch surface from the seal end to the discharge end, toward the bearing compartment.

According to one aspect of the present invention, a baffle is provided attached to one of the inner or outer spools adjacent the discharge end of the catch surface. The end surface of the baffle is in close proximity to the other of the inner or outer spools.

According to another aspect of the present invention, a dam is provided extending out from the catch surface, in a direction substantially perpendicular to the axis, along the seal end of the catch surface.

According to another aspect of the present invention, a plurality of blades are provided, extending out from the catch surface, circumferentially distributed around the catch surface.

An advantage of the present invention is that liquid can be maintained within a compartment between spools without the use of buffer air. The present invention utilizes centrifugal force to drive liquid disposed between the inner spool and the catch surface radially outward and into the catch surface. The angle of the catch surface, canted radially outward from the seal end to the discharge end, drives the liquid back into the bearing compartment.

Another advantage of the present invention is that it eliminates the need for a heat exchanger and/or an oil/air separator, and therefore the cost and weight associated therewith.

Another advantage of the present invention is that it eliminates the need for buffer air as a sealing means and therefore the inefficiencies associated with using buffer air as a sealing means.

Another advantage of the present invention is that it eliminates the heat exchanger and/or oil/air separator and the opportunity for negatively affecting the reliability of the engine.

Another advantage of the present invention is that it may be used in high relative rotational velocity applications, such as counter-rotating spools. Carbon and other materials used in contact seals often have rotational limitations due to the development of thermal energy and stress associated therewith. The present invention seals between spools without contact and thereby avoids the undesirable thermal energy and stress which results from contact.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
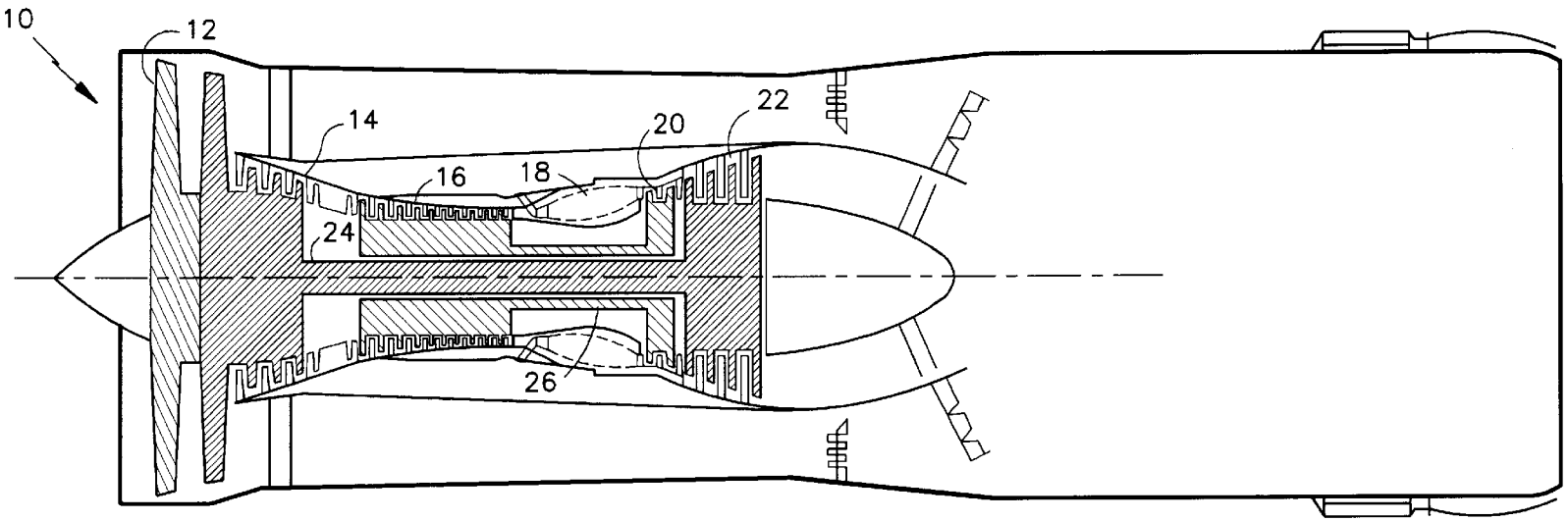
FIG. 1 is a diagrammatic sectional view of a gas turbine engine.
Figure 2:
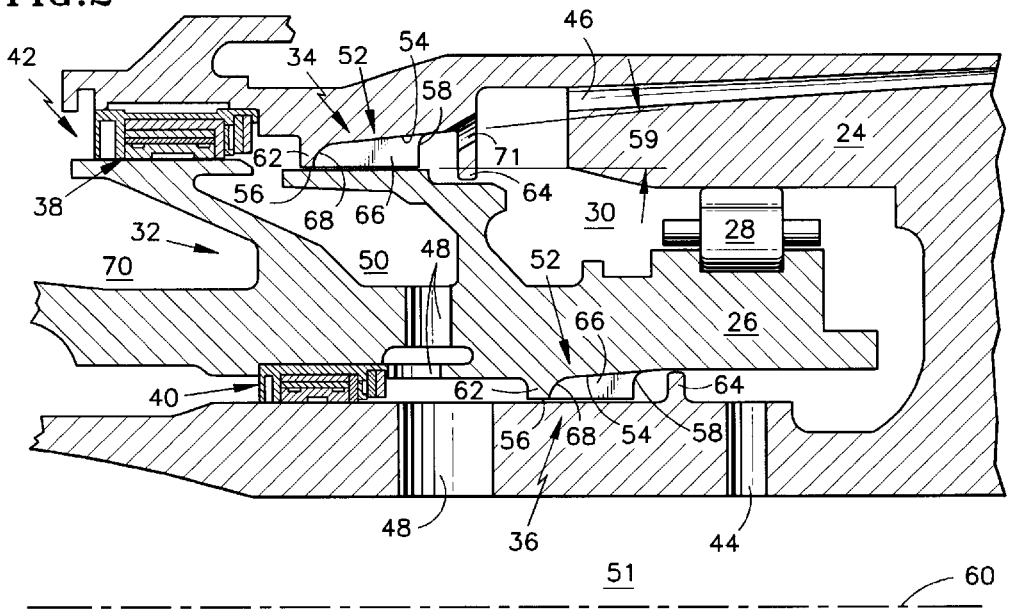
FIG. 2 is a diagrammatic sectional view of a two spool bearing compartment, showing the present invention seal including a dam and blades.
Figure 3:
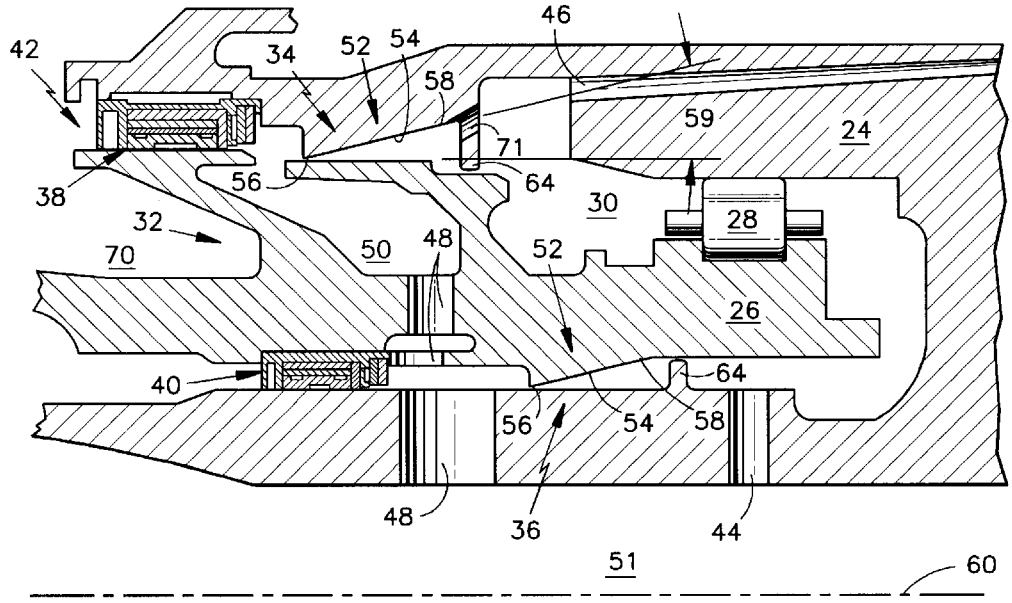
FIG. 3 is a diagrammatic sectional view of a two spool bearing compartment, showing the present invention seal with a catch surface only.

Referring to FIG. 1, a gas turbine engine 10 includes a fan section 12, a low pressure compressor 14, a high pressure compressor 16, a combustor section 18, a high pressure turbine 20, and a low pressure turbine 22. A low speed spool 24 connects the fan section 12, low pressure compressor 14, and low pressure turbine 22 together. The low pressure turbine 22 drives the fan section 12 and low pressure compressor 14. A high speed spool 26 connects the high pressure compressor 16 and high pressure turbine 20 together. The high pressure turbine 20 drives the high pressure compressor 16. Bearings 28 (not shown in FIG. 1—see FIGS. 2 and 3) disposed between the high 26 and low 24 speed spools help maintain the spools 24,26 in a coaxial relationship. FIG. 1 shows a diagrammatic sectional view of a gas turbine for illustrative purposes, having cylindrical spools. In most applications, the spools have complex geometries to accommodate design parameters such as loading and cooling. FIGS. 2 and 3 show a diagrammatic section between the high 26 and low 24 speed spools in the vicinity of a bearing compartment 30.

Referring to FIGS. 2 and 3, an extension of the high speed spool 26 is received within a pocket 32 of the low speed spool 24. A bearing 28 is disposed between, and in contact with, both spools 24,26. A first 34 and a second 36 oil seal and a first 38 and a second 40 air seal are disposed in the pocket 32 between the opening 42 of the pocket 32 and the bearing 28, together forming the bearing compartment 30. The oil seals 34,36 are positioned between the air seals 38,40 and the bearing 28. The air seals 38,40 shown are commonly known as "control gap seals". Other air seals may be used alternatively. An oil inlet 44 and drain 46 are disposed in the pocket 32 on the bearing side of the first 34 and second 36 oil seals. Air passages 48 connect the annulus 50 between the oil seals 34,36 and the air seals 38,40 to an adjacent compartment 51.

Figure 4:
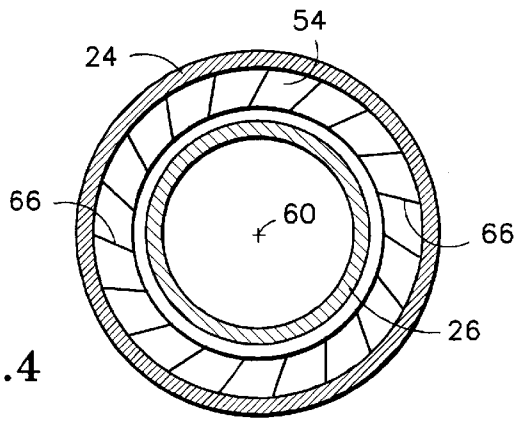
FIG. 4 is a diagrammatic axial view of coaxial spools showing the blades circumferentially distributed around the catch surface.

The first oil seal 34, attached to the low speed spool 24, and the second oil seal 36, attached to the high speed spool 26, each include a flange 52 having a catch surface 54 with a seal end 56 and a discharge end 58. The catch surface 54 is disposed at an angle 59 relative to the axis of rotation 60 of the spools 24,26, such that the seal end 56 of the catch surface 54 is radially closer to the axis 60 than the discharge end 58 of the catch surface 54. In the embodiment shown in FIG. 2, a dam 62 is positioned adjacent the seal end 56. The dam 62 extends radially toward whichever spool 24,26 lies opposite the oil seal 34,36. A baffle 64 is positioned adjacent the discharge end 58 of the catch surface 54. The baffle 64 extends radially out from one of the high 26 or low 24 speed spools to a position in close proximity to the other of the high 26 or low 24 speed spools. In the embodiment shown in FIGS. 2 and 4, a plurality of blades 66 are attached to the catch surface 54. The blades 66 extend radially out from the catch surface 54 to a position in close proximity to the opposing high 26 or low 24 speed spool. Depending upon the application, it may be advantageous to use flat blades, disposed at an angle relative to the rotational axis 60 of the spools 24,26, or arcuate blades.

In the operation of the gas turbine engine, the low 24 and high 26 speed spools may co-rotate at different rotational velocities, or counter-rotate relative to one another. In both cases, the difference in velocity and/or rotational direction creates turbulence within the oil and air disposed in the bearing compartment 30 and adjacent compartments. A portion of the oil becomes entrained within the air and flows erratically within the bearing compartment 30. The baffles 64 adjacent the discharge end 58 of the oil seal 34,36 prevent a substantial amount of oil from reaching the oil seals 34,36, but a percentage of oil, generally entrained within air, still reaches the oil seal 34,36. Oil contacting the surface of the rotating spool 24,26 opposite the catch surface 54 is flung across to the catch surface 54 by centrifugal force. Oil contacting the rotating catch surface 54 is forced against the surface 54 by centrifugal force. In the embodiment where the catch surface 54 includes a dam 62 (see FIG. 2), the radial surface 68 of the dam 62 provides a blunt surface to impede axially directed flow. In the embodiment including blades 66 extending out from the catch surface 54, the blades 66 serve as an impeller urging air flow and oil in the direction toward the bearing compartment 30, away from the oil seal 34,36. The blades 66 also accelerate any air in close proximity to the blades 66 in a circumferential direction. As a result, any oil that may be entrained within the air is subject to centrifugal forces and therefore separation from the air.

In all embodiments, the proximity of the catch surface 54 relative to the opposing spool 24,26, the angle 59 of the catch surface 54 relative to the axis of rotation 60 of the spools 24,26, and the turbulence in the air disposed between the catch surface 54 and the opposing spool 24,26, cause any oil entrained within the air to end up on the catch surface 54 of the radially outer spool 24,26. Once the oil is on the catch surface 54, the angle 59 of the catch surface 54 relative to the axis of rotation 60 causes the oil to travel down the catch surface 54 from the seal end 56 to the discharge end 58. A drain hole 71 may be disposed near the discharge end 58 if necessary.

The air seals 38,40 disposed between the opening 42 of the pocket 32 and the oil seals 34,36 prevent hot air in adjacent compartments 70 from entering the bearing compartment 30. Any hot air passing by the air seals 38,40 is vented from the annulus 50 between the air seals 38,40 and the oil seals 34,36 into an adjacent compartment via passages 48 before it can enter the bearing compartment 30.

Although this invention has been shown and described with respect to the detailed embodiments thereof, it will be understood by those skilled in the art that various changes in form and detail thereof may be made without departing from the spirit and scope of the claimed invention.

I claim:

1. A seal for coaxial first and second turbine spools rotatable about an axis, wherein the first turbine spool has a section radially outside the second turbine spool, comprising:

a flange, attached to the section of first spool radially outside the second spool, said flange extending radially inward toward said second spool, said flange having a catch surface, in close proximity to the second spool, which includes a seal end and a discharge end;

a baffle, attached to one of the section of first spool radially outside the second spool, or the second spool, adjacent said discharge end of said catch surface, said baffle having an end surface in close proximity to the other of the section of first spool radially outside the second spool, or the second spool; and a plurality of blades, extending out from and circumferentially distributed around, said catch surface;

wherein between said seal end and discharge end, said catch surface is canted from the axis;

and wherein liquid disposed between the second spool and said catch surface is forced against said catch surface by centrifugal force when the spools rotate at a sufficient speed, and said fluid is driven axially along said canted catch surface in the direction from said seal end to said discharge end.

2. A seal for coaxial first and second turbine spools rotatable about an axis, wherein the first turbine spool has a section radially outside the second turbine spool, comprising:

a flange, attached to the section of first spool radially outside the second spool, said flange extending radially inward toward said second spool, said flange having a catch surface, in close proximity to the second spool, which includes a seal end and a discharge end; and a plurality of blades, extending out from and circumferentially distributed around, said catch surface;

wherein between said seal end and discharge end, said catch surface is canted from the axis;

and wherein liquid disposed between the second spool and said catch surface is forced against said catch surface by centrifugal force when the spools rotate at a sufficient speed, and said fluid is driven axially along said canted catch surface in the direction from said seal end to said discharge end.

* * * * *